US005518415A

United States Patent [19]

Sano

[11] Patent Number: 5,518,415

[45] Date of Patent: May 21, 1996

[54] CONNECTOR

[75] Inventor: Takahiro Sano, Shizuoka, Japan

[73] Assignee: Yazaki Corporation, Tokyo, Japan

[21] Appl. No.: 338,224

[22] Filed: Nov. 9, 1994

[30] Foreign Application Priority Data

Nov. 11, 1993 [JP] Japan ..... 5-282269

[51] Int. Cl.[6] ..... H01R 4/60

[52] U.S. Cl. ..... 439/204; 439/589; 439/936

[58] Field of Search ..... 439/199, 201, 439/204, 587, 589, 936, 701

[56] References Cited

U.S. PATENT DOCUMENTS

| | | | |
|---|---|---|---|
| 3,970,352 | 7/1976 | Dorrell et al. | 439/936 X |
| 4,927,386 | 5/1990 | Neuroth | 439/589 |
| 5,145,402 | 9/1992 | Plyler et al. | 439/936 X |
| 5,278,357 | 1/1994 | Yamanashi | 439/936 X |

FOREIGN PATENT DOCUMENTS

| | | |
|---|---|---|
| 2278673 | 11/1990 | Japan . |
| 6196218 | 7/1994 | Japan . |

*Primary Examiner*—Khiem Nguyen
*Attorney, Agent, or Firm*—Sughrue, Mion, Zinn, Macpeak & Seas

[57] ABSTRACT

This invention relates to provide a connector in which rearward withdrawal of metal terminals are positively prevented, and a complete waterproof effect is obtained by a filled sealing material. Wire connecting portions of metal terminals, connected respectively to ends of wires passed through insertion holes in a waterproof plug and a rear holder, are engaged with the rear holder, and the metal terminals are received respectively in terminal receiving chambers in a connector housing, and the rear holder is fixed by retaining pieces at a position rearwardly of the terminal receiving chambers, and the waterproof plug is fitted in the connector housing, and a sealing material is filled in the connector housing.

5 Claims, 4 Drawing Sheets

CONNECTOR

BACKGROUND OF THE INVENTION

1. Field of the Invention

This invention relates to a connector used for connecting wires in an automobile or the like.

2. Related Art

In FIG. 5, a waterproof connector housing a is relatively long, and it is inefficient and inferior in certainty to individually insert metal terminals, each having a wire connected thereto, into such a deep connector housing a and to retain these metal terminals relative thereto. Therefore, terminal receiving chambers for respectively receiving the metal terminals are not provided in the connector housing a, and instead there is provided a terminal support member b as shown in FIG. 6, and metal terminals d, each having a wire c connected thereto, are received respectively in terminal receiving chambers b1 in the terminal support member b, and contact portions d1 of the metal terminals are projected forwardly from through holes b2, respectively, thereby provisionally retaining the plurality of metal terminals d relative to the terminal support member b. Then, the terminal support member b in this condition is inserted into a receiving chamber a1 of the connector housing a from a front side thereof to engage retaining projections b3 with a step portion a2, and then a synthetic resin f of high hardness such as an epoxy resin is injected into the receiving chamber a1 at a region between a rubber plug e and the rear side of the terminal support member b, thereby finally preventing the metal terminals d from rearward withdrawal.

In the above construction, the resin of high hardness such as an epoxy resin is susceptible to cracking, and hence is inferior in sealing performance, and besides since the wires c need to be passed through the rubber plug e into the connector housing a, there is encountered a drawback that the efficiency of the operation is low.

SUMMARY OF THE INVENTION

The present invention has been made in view of the above problems, and an object of the invention is to provide a connector in which metal terminals can be firmly retained relative to a terminal support member inserted into a connector housing, and the terminal support member can be attached to the connector housing easily and surely.

The above object has been achieved by a connector wherein wire connecting portions of metal terminals, connected respectively to ends of wires passed through insertion holes in a waterproof plug and a rear holder, are engaged with the rear holder; the metal terminals are received respectively in terminal receiving chambers in a connector housing; the rear holder is fixed by retaining pieces at a position rearwardly of the terminal receiving chambers; the waterproof plug is fitted in the connector housing; and a sealing material is filled in the connector housing.

The wire connecting portions of the metal terminals are engaged with the rear holder fixed within the connector housing, thereby preventing rearward withdrawal of the metal terminals.

DESCRIPTION OF THE PREFERRED EMBODIMENTS

Figure 1:
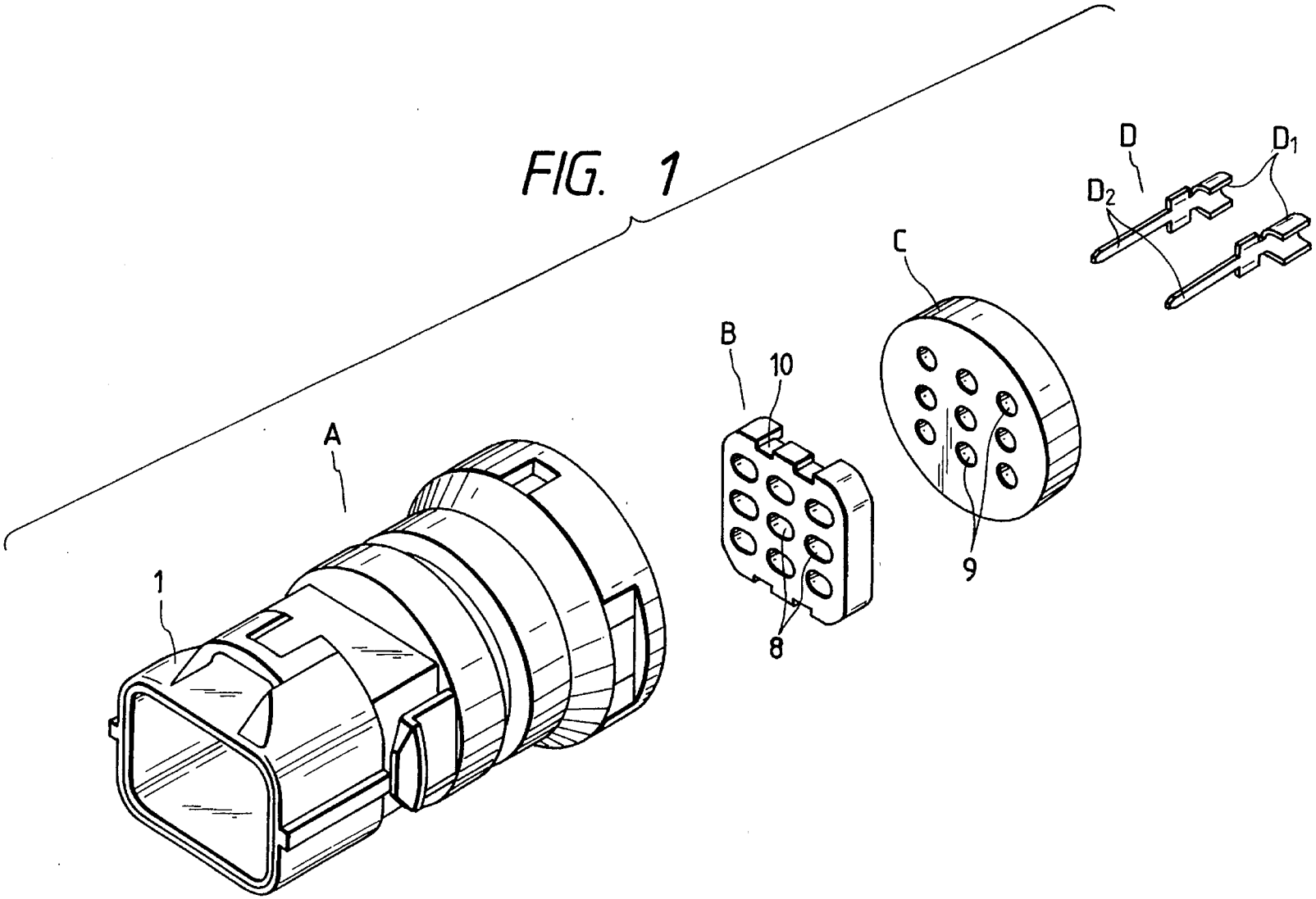
FIG. 1 is an exploded perspective view of one preferred embodiment of the present invention.

In FIG. 1, reference character A denotes a connector housing of a synthetic resin, reference character B a rear holder of a synthetic resin, reference character C a waterproof plug of rubber, and reference character D a metal terminal.

Figure 2:
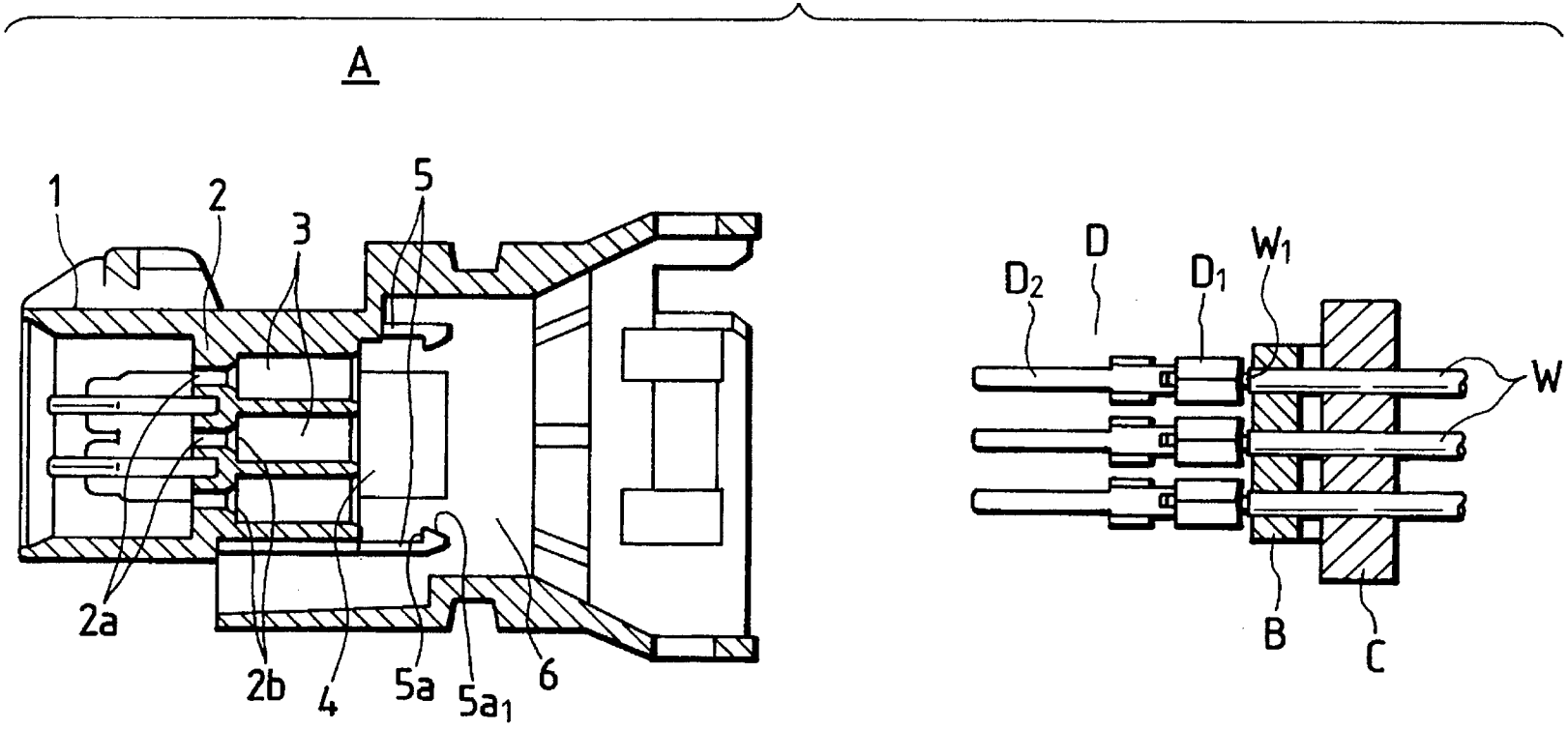
FIG. 2 is a cross-sectional view of the above embodiment in its half-assembled condition.
Figure 3:
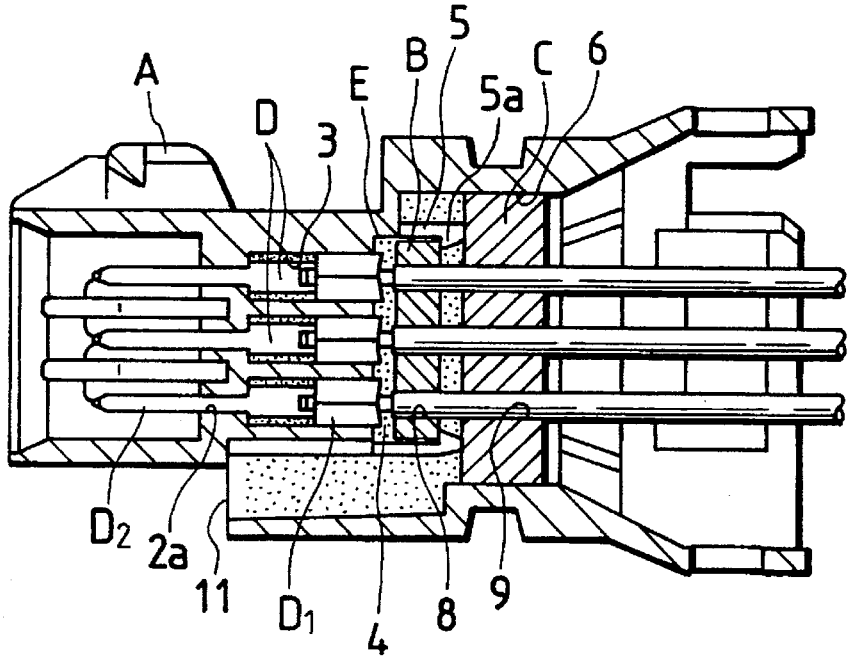
FIG. 3 is a cross-sectional view of the above embodiment in its completely-assembled condition.

As shown in FIG. 2, the connector housing A includes a hood portion 1 for receiving a mating male connector housing (not shown), a partition wall 2 having a plurality of insertion holes 2*a*, a plurality of terminal receiving chambers 3 in communication with the respective insertion holes 2*a*, a rear holder receiving portion 4, rear holder-supporting elastic retaining pieces 5, and a waterproof plug receiving portion 6, these portions being arranged in this order from the front side of the connector housing A toward the rear side thereof.

In the above construction, a tapering guide surface 2*b* is formed to extend between a front end of each terminal receiving chamber 3 and the associated insertion hole 2*a*. A retaining projection 5*a* having a tapering guide surface 5*a*1 is formed on a free end of each of the rear holder-supporting elastic retaining pieces 5 (which extend rearwardly) provided at opposite sides of the group of terminal receiving chambers 3.

A plurality of laterally-elongated insertion holes 8 are formed through the rear holder B, and a plurality of circular insertion holes 9 are formed through the waterproof plug C, the holes 8 as well as the holes 9 corresponding to the terminal receiving chambers 3, respectively. Engagement portions 10 for the rear holder-supporting elastic retaining pieces 5 are formed at the upper and rear surfaces of the rear holder B.

Figure 4:
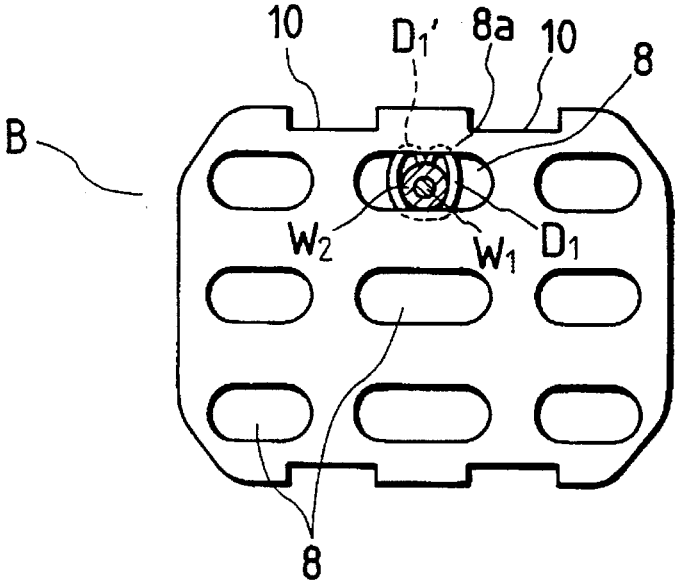
FIG. 4 is a front-elevational view of a rear holder.
Figure 5:
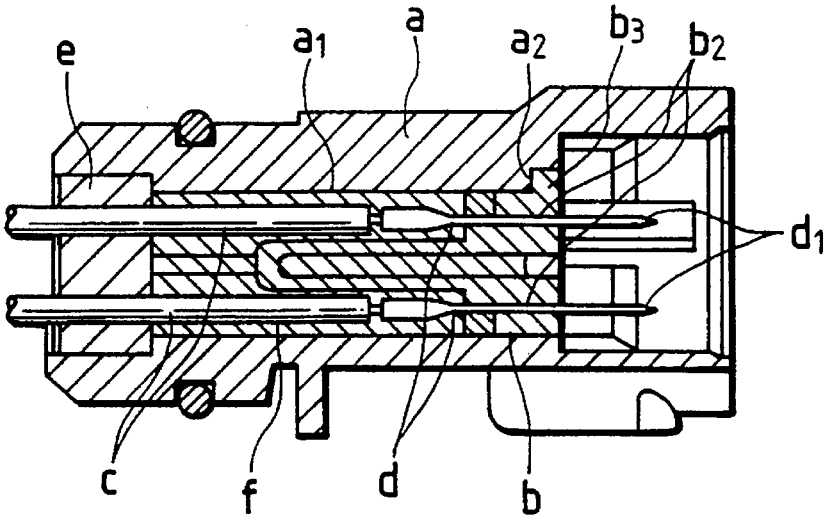
FIG. 5 PRIOR ART
FIG. 5 is a cross-sectional view of a conventional example.
Figure 6:
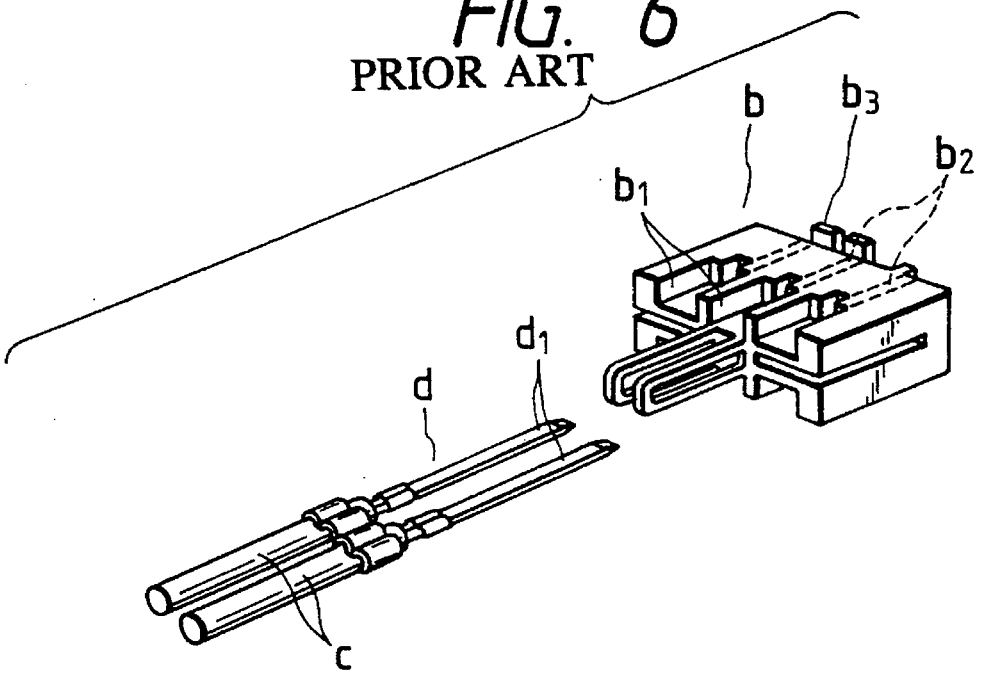
FIG. 6 PRIOR ART
FIG. 6 is a perspective view of a terminal support member of the above conventional example.

For assembling the above construction, first, coverings are removed from end portions of a plurality of wires W beforehand passed through the insertion holes 8 and 9 in the rear holder B and the waterproof plug C, and then wire connecting portions D1 of the metal terminals D are compressively connected to conductors W1 of the wires, respectively. At this time, retaining projections D1', which are formed at the wire connecting portion D1 and project in a curved manner so as to embrace the wire covering W2, is engaged with a peripheral edge portion 8a of the insertion hole 8 in the rear holder B, thereby preventing withdrawal (see FIG. 4).

In this condition, each of the metal terminals D is inserted into the associated terminal receiving chamber 3 of the connector housing A, and a male electrical connection portion D2 of the terminal is passed through the insertion hole 2*a* through the tapering guide surface 2*b*, thereby effecting a provisional retaining. Then, the rear holder B is moved into the receiving portion 4, so that the opposed elastic retaining pieces are outwardly deformed, and hold the rear holder therebetween. The retaining projections 5*a* of the restored free ends are engaged respectively in the engagement portions 10, thereby fixing the rear holder. At this time, the incompletely-inserted metal terminals D are automatically brought into the completely-inserted position.

Then, the waterproof plug C is moved along the wires W, and is press-fitted in the receiving portion 6, and then a sealing material E of sufficiently-soft silicone rubber is filled in the terminal receiving chambers 3 and the rear holder receiving portion 4 through an injection hole 11.

In the present invention, the wire connecting portions of the metal terminals, connected respectively to the ends of the wires passed through the insertion holes in the waterproof plug and the rear holder, are engaged with the rear holder, and the metal terminals are received respectively in the terminal receiving chambers in the connector housing, and the rear holder is fixed by the retaining pieces at a position rearwardly of the terminal receiving chambers, and the waterproof plug is fitted in the connector housing, and the sealing material is filled in the connector housing. Therefore, the rear holder can be fixed easily, and the rearward withdrawal of the metal terminals can be positively prevented by the rear holder. Therefore, the waterproof filling material does not need to perform a terminal fixing function, and as a result a soft elastic material such as silicone rubber can be used as the waterproof filling material, so that a good waterproof performance can be obtained.

What is claimed is:

1. A connector comprising:

metal terminals including wire connecting portions for respectively grasping ends of wires and retaining projections;

a rear holder having insertion holes through which said wires respectively pass;

a connector housing including an elastic retaining piece having a retaining projection for retaining the rear holder in a rear holder receiving chamber of said connector housing; and an elastic material filled in the rear holder receiving chamber of the connector housing so as to at least partially surround and seal said rear holder, wherein said insertion holes have a diameter which is smaller than a lateral dimension of said terminals including said retaining projections such that said terminals cannot pass through said insertion holes in either direction and wherein said terminals are secured to said wires after said wires have been inserted through said insertion holes.

2. The connector as claimed in claim 1, wherein the metal terminals are received respectively in terminal receiving chambers, each terminal receiving chamber have a tapering guide surface which is formed to extend between a front end of each terminal receiving chamber and an associated insertion hole in the connector housing.

3. The connector as claimed in claim 1, wherein the metal terminals are automatically brought into the completely-inserted position by fitting the rear holder to the elastic retaining pieces in the connector housing.

4. The connector of claim 1, further comprising a waterproof plug having wire receiving holes through which said wires respectively pass, said waterproof plug being received in said connector housing adjacent said rear holder.

5. The connector of claim 1, where said retaining projection has a tapered guide surface formed on a free end thereof.

* * * * *